United States Patent [19]

Jost

[11] 4,036,518

[45] July 19, 1977

[54] DOOR BRACE

[76] Inventor: Eduard Jost, 656 E. 45th Ave., Vancouver, British Columbia, Canada, V5W 1Y7

[21] Appl. No.: 697,993

[22] Filed: June 21, 1976

[51] Int. Cl.[2] ..... E05C 17/54

[52] U.S. Cl. ..... 292/339

[58] Field of Search ..... 292/338, 339, 262; 248/356, 357, 354 P, 316 B; 70/16; 211/119.01; 24/249 PP, 249 PC, 249 DP, 249 R

[56] References Cited

U.S. PATENT DOCUMENTS

| | | | |
|---|---|---|---|
| 164,088 | 6/1875 | Hunter | 24/249 PP |
| 598,405 | 2/1898 | Williams | 292/339 |
| 1,606,149 | 11/1926 | Crewson | 292/338 |
| 3,437,296 | 4/1969 | Hinz | 248/357X |

*Primary Examiner*—Richard E. Moore

*Attorney, Agent, or Firm*—Fetherstonhaugh & Company

[57] ABSTRACT

A device for bracing a door against being forced open from the outside is an extensible rod having a floor-gripping member on one end and a door handle-gripping pair of jaws on the opposite end. The pair of jaws are pivotally mounted and shaped so that opposing edges of the jaws are wedged into clamping engagement with the door handle with a force proportionate to the force being used to push the door against the brace.

2 Claims, 3 Drawing Figures

DOOR BRACE

My invention relates to improvements in door securers.

A conventional door lock can be circumvented if sufficient force is applied to the door and this method of gaining illegal entry to a building is quite often used by intruders. Attempts have been made to defeat this type of breaking and entering by simply bracing the door on the inside but a resourceful burglar can apply leverage to the door in such a way as to cause the brace to slip either on the floor or on the door handle.

I overcome the disadvantages of conventional door securers by providing a brace which is unlikely to skid on a hardwood floor or carpet and which will increase its gripping action on the door handle should an attempt be made to force open the door. To achieve this effect, the present invention contemplates a brace for a door which comprises a rod adapted to be wedged between an adjacent floor surface and a handle on said door, a pair of jaws, pivot means securing each of the pair of jaws to an upper end of the rod for swinging movement towards and away from one another, said pair of jaws having opposing edges for engaging opposite sides of the handle, said opposing edges being shaped and located relative to the pivot means whereby a force applied to open the door tends to tighten the grip of the pair of jaws upon the handle.

In drawings which illustrate a preferred embodiment of the invention,

Figure 1:
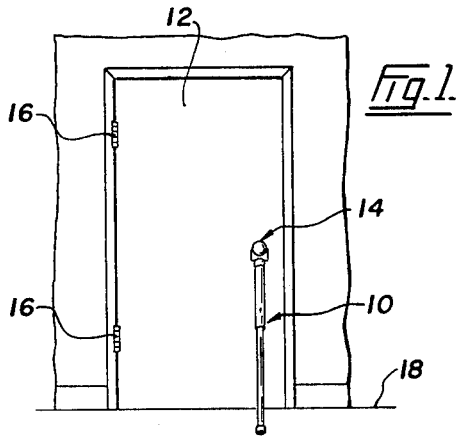
FIG. 1 is a front elevation of a door secured by means of the present door brace.

Referring first to FIG. 1 of the drawings, the numeral 10 indicates generally a door brace embodying the improvements of the present invention. The brace 10 is shown in a typical position of use securing a door 12, fitted with the usual handle 14, against being swung inwardly upon its hinges 16. The numeral 18 designates the floor of the room guarded by the inwardly swinging door.

Figure 2:
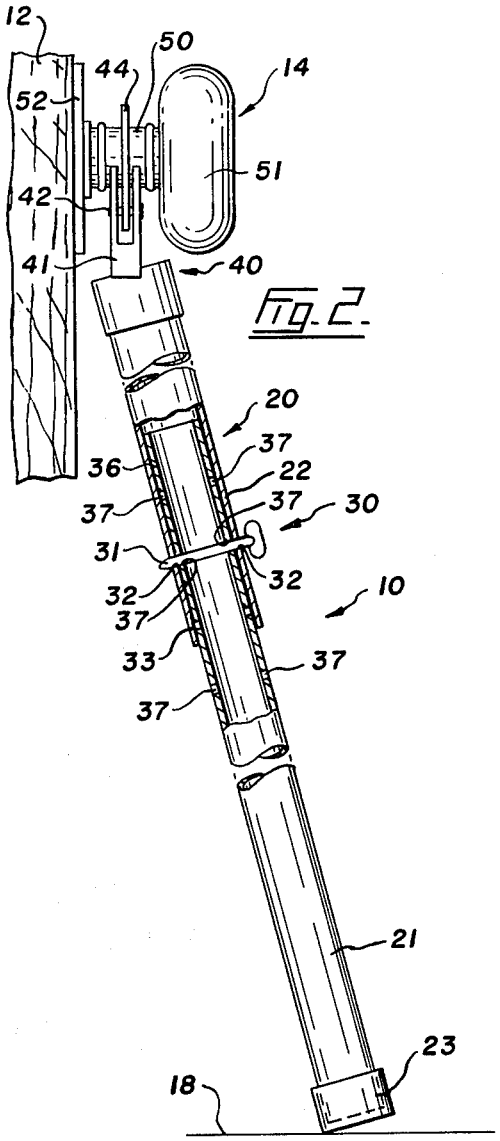
FIG. 2 is an enlarged side elevation, part broken away, showing the door brace in position of use.
Figure 3:
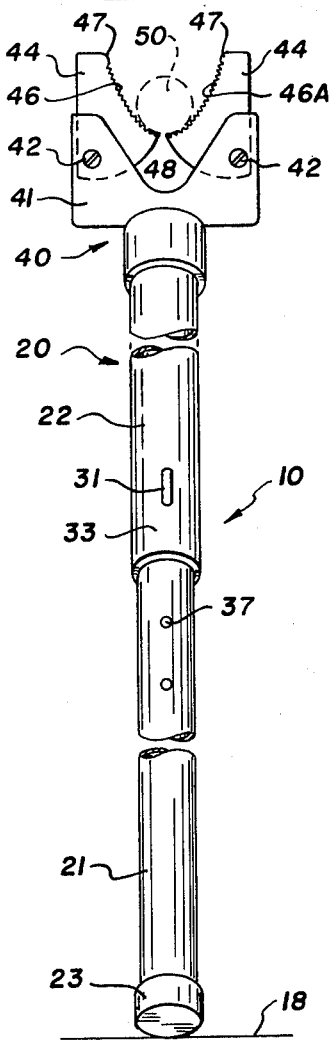
FIG. 3 is an enlarged front elevation, also part broken away, showing the door brace in the same position of use.

As best shown in FIGS. 2 and 3, the brace 10 comprises a tubular rod 20 having telescoping lower and upper portions 21 and 22. The lower end of the portion 21 is fitted with a cap 23 formed of rubber or other material not likely to skid when pressed into contact with the floor 18.

The effective length of the rod 20 is adjustable to suit the height of the handle 14 above the floor 18, as well as to vary the angle of the rod with respect to the face of the door, and this adjustment is accomplished by means generally indicated at 30. FIGS. 2 and 3 show the means 30 as comprising a pin 31 which projects through holes 32 formed in opposite sides of the portion 22 near lower edge 33 thereof. The lower portion 21 of the rod has an upper end 36 which is provided with a plurality of holes 37 and these holes are suitably spaced apart along rows on opposite sides of the upper end to receive the pin 31. Thus, with the pin 31 removed, the rod 20 can be shortened or lengthened as required and can then be locked in the adjusted position by reasserting the pin so that it projects through transversely aligned holes 32 and 37.

The upper end of the rod portion 22 is fitted with a head 40 having transversely spaced forks 41. A pivot bolt 42 is fitted to the head to extend through each fork 41 and swingingly mounted on this bolt is a jaw 44. The pair of coacting jaws 44 have opposing edges 46 which are reversely curved, that is, they have rounded outer ends 47 and upturned inner ends 48, the latter ends being closely spaced from one another as shown in FIG. 3. The opposing edges 46 are provided with serrations 46A which are shown in FIG. 3 and these serrations provide positive non-skid surfaces for the jaws. Alternatively, the edges 46 may be faced with rubber or other suitable material which will ensure that the jaws are capable of firmly gripping an object therebetween and without slippage.

Referring now to FIG. 2, the door handle 14 will be seen to have a horizontal spindle 50 which terminates in a knob 51. The pair of jaws 44 are adapted to grip the spindle 50 approximately midway between the knob 51 and the rose 52 which bears against the inner face of the door 12. In order to hold the door shut, the brace 10 is positioned as indicated in FIG. 2 so that the longitudinal axis of the rod 20 forms an acute angle with the adjacent face of the door when the cap 23 is in firm, gripping contact with the floor. The angle formed by the rod can be varied if desired by adjusting the length of the rod using the means 30. When the brace is wedged between the floor and the handle, the spindle 50 is lodged between the pair of jaws 44 as shown in FIG. 3 and thus the door is supported so that it cannot be pushed open from the outside.

Should a would-be intruder try to push the door open from outside the room, the jaws 44 tend to bite even harder into the spindle 50 and thus the door is firmly held against forceful entry. Since there is no loose play in the door when held by the present brace, the door cannot be rattled to dislodge the rod by sliding it along the floor or loosening the grip of the jaws upon the handle.

From the foregoing, it will be seen I have provided an extremely simple and economical device for holding a door shut from the inside. It is a simple matter to release the brace from its door-holding position whenever someone wishes to exit from the room.

I claim:

1. A brace for a door comprising a telescopic rod having upper and lower ends, means for selectively adjusting the length of the rod, a floor-gripping member on the lower end, a head fitted to the upper end, a pair of jaws mounted on the head, pivot means securing each jaw to the head for swinging movement between handle-gripping and handle-releasing positions, said pair of jaws having opposing edges provided with non-skid surfaces, said opposing edges having opposite curvature and being spaced with respect to the pivot means whereby a force applied to open the door tends to tighten the grip of the pair of jaws upon the handle.

2. A brace as claimed in claim 1, in which said opposing edges are serrated.

* * * * *